US005459559A

United States Patent [19]

Nagase et al.

[11] Patent Number: 5,459,559

[45] Date of Patent: Oct. 17, 1995

[54] MAGNETIC BRUSH DEVELOPING METHOD USING A TWO-COMPONENT DEVELOPER

[75] Inventors: Yukio Nagase, Tokyo; Kenichiro Waki, Kawasaki; Hiroyuki Suzuki, Yokohama; Masaru Hibino, Kawasaki, all of Japan

[73] Assignee: Canon Kabushiki Kaisha, Tokyo, Japan

[21] Appl. No.: 318,298

[22] Filed: Oct. 5, 1994

[30] Foreign Application Priority Data

Oct. 29, 1993 [JP] Japan ..... 5-294482
Jul. 11, 1994 [JP] Japan ..... 6-180459

[51] Int. Cl.[6] ..... G03G 13/09

[52] U.S. Cl. ..... 355/251; 118/656; 118/657

[58] Field of Search ..... 355/251, 253; 118/656–658

[56] References Cited

U.S. PATENT DOCUMENTS 4,838,200 6/1989 Hosoi et al. ..... 118/658
4,873,551 10/1989 Tajima et al. ..... 355/251
5,078,085 1/1992 Fuji et al. ..... 355/251 X
5,202,730 4/1993 Fuji et al. ..... 355/251
5,296,328 3/1994 Fuji et al. ..... 355/251 X
5,420,215 3/1995 Yamagi ..... 355/251

FOREIGN PATENT DOCUMENTS 0131576 5/1989 Japan .

*Primary Examiner*—Matthew S. Smith
*Attorney, Agent, or Firm*—Fitzpatrick, Cella, Harper & Scinto

[57] ABSTRACT

A developing method for developing an electrostatic image on an image bearing member with a two-component developer includes the steps of bearing a developer containing toner particles and carrier particles on a developer bearing member to a contact region formed between the developer bearing member and an image bearing member bearing an electrostatic image thereon, and rubbing the image bearing member with the magnetic brush with a contact pressure equal to 0.7 gf/cm$^2$ or less.

6 Claims, 7 Drawing Sheets

MAGNETIC BRUSH DEVELOPING METHOD USING A TWO-COMPONENT DEVELOPER

BACKGROUND OF THE INVENTION

1. Field of the Invention

The present invention relates to a developing method used in an image forming apparatus, such as an electrophotographic or electrostatic recording printer, a copying machine, or the like, and more particularly, to a developing method using a two-component developer.

DESCRIPTION OF THE RELATED ART

Selenium, amorphous silicon and organic photo-conductors and the like have been put to practical use as a photo-conductor in an electrophotographic process. Particularly, an amorphous silicon photo-conductor is regarded as excellent in stability and durability.

Various kinds of developing methods also have been suggested, and apparatus adopting these methods have been used. The developing methods generally may be divided into monocomponent developing methods and two-component developing methods. Most of the monocomponent developing methods are of the non-contact type, and a monocomponent jumping development method using magnetic toner is a typical one. Although high image quality can be achieved by a simple structure in this method, color images cannot be obtained since each particle of the toner contains a magnetic substance. A monocomponent developing method using non-magnetic toner can form color images. However, it is difficult to apply the toner onto a developing sleeve, and the toner conventionally must be applied by using an elastic blade. This lowers the stability and durability of the toner.

On the other hand, a two-component developing method transports toner including magnetic carrier particles to a developing area and forms a magnetic brush made of the toner and the magnetic carrier to carry out development. Iron carrier particles, ferrite carrier particles and the like may be used as the magnetic carrier. However, the magnetic brush made of the toner and the magnetic carrier rubs the photoconductor and disturbs the electrostatic image thereon, and therefore, high image quality cannot be obtained.

This is because the pressure at which the magnetic brush of the developer presses a photoconductor typically is high, e.g., 10 to 80gf/cm$^2$ with use of an iron carrier and 3 to 10gf/cm$^2$ with use of a ferrite carrier.

A method for solving the above problem has been suggested. In this method, a ferrite carrier of high resistance is used, the brush pressure is lowered to approximately 2gf/cm$^2$ by providing a thin layer or coating of developer on the developer bearing member, and an alternating electric field is applied between the developer bearing member and the image bearing member as a developing bias, thereby obtaining images of high density.

According to this method, disturbance of the images by brushing and so on hardly occurs and images of high quality can be obtained. Furthermore, since non-magnetic toner can be used, color images also can be obtained.

However, when image formation is performed in such a developing method in which an alternating bias is applied, a phenomenon in which toner adheres to a white portion where the toner should not essentially adhere, what is called "fogging", is liable to occur.

The state in which fogging occurs differs according to the type of a photoconductor used. In particular, an amorphous silicon photoconductor is more liable to cause fogging compared with other photoconductors.

FIG. 10 is a graph providing a comparison in fog amount between an organic photoconductor and an amorphous silicon photoconductor. In FIG. 10, the fog amount is expressed as the fog reflectance relative to the fog removal potential. Although a developing bias having a fog removal potential 100V to 150V different from the potential of a white portion on a photoconductor is ordinarily applied to a developing sleeve to remove fog in the white portion, it is clear that the fog amount is relatively large when amorphous silicon is used.

In a color image forming apparatus which forms a dot latent image by using a laser optical system or the like, and expresses a halftone image, high image quality is frequently required, and particularly, reproducibility of highlights is strongly required. However, since fogging occurs in a conventional image forming apparatus, reproducibility of highlights presently is not sufficient.

SUMMARY OF THE INVENTION

It is an object of the present invention to provide a developing method capable of forming a high-quality image without any fog.

It is another object of the present invention to provide a developing method having an excellent reproducibility for a highlight.

In one aspect, the present invention is a developing method comprising the steps of bearing a developer including toner particles and carrier particles on a developer bearing member to a contact region formed between the developer bearing member and an image bearing member bearing an electrostatic latent image thereon, and rubbing the image bearing member with the magnetic brush formed on the developer bearing member with a contact pressure less than or equal to 0.7gf/cm$^2$.

Other objects and features of the present invention will become apparent from the following description.

BRIEF DESCRIPTION OF THE DRAWINGS

FIG. 4 is a graph showing a hysteresis curve of a magnetic carrier;

FIG. 5 is a graph showing the relationship between the S-D gap and the contact pressure;

DESCRIPTION OF THE PREFERRED EMBODIMENTS

Embodiments of developing methods according to the present invention will now be described in conjunction with an image forming apparatus.

As full-color printing and systematization have been achieved in an image forming apparatus, such as a copying machine, a printer, or the like, digitization of a control portion has been recently developed.

For example, a conventional apparatus, such as a laser beam printer, scans laser light, forms a dot latent image on a photo-conductive drum according to ON/OFF switching of the laser light, and records a desired image. A typical use thereof is binary recording of characters, figures, and the like. Since such recording of characters and figures does not require halftone developing, the structure of the apparatus can be simplified.

On the other hand, some printers of the binary recording type can produce halftone images. In particular, printers using the dithering method, the density pattern method and the like are well known. However, as is widely known, such printers cannot obtain images of high resolution. A multi-valued recording method for producing halftone images in the minimum recording unit without lowering the high recording density recently has been suggested. This method produces halftone images by conducting pulse width modulation (PWM) on a laser beam according to image signals, thereby forming images of high resolution and gradient.

Figure 1:
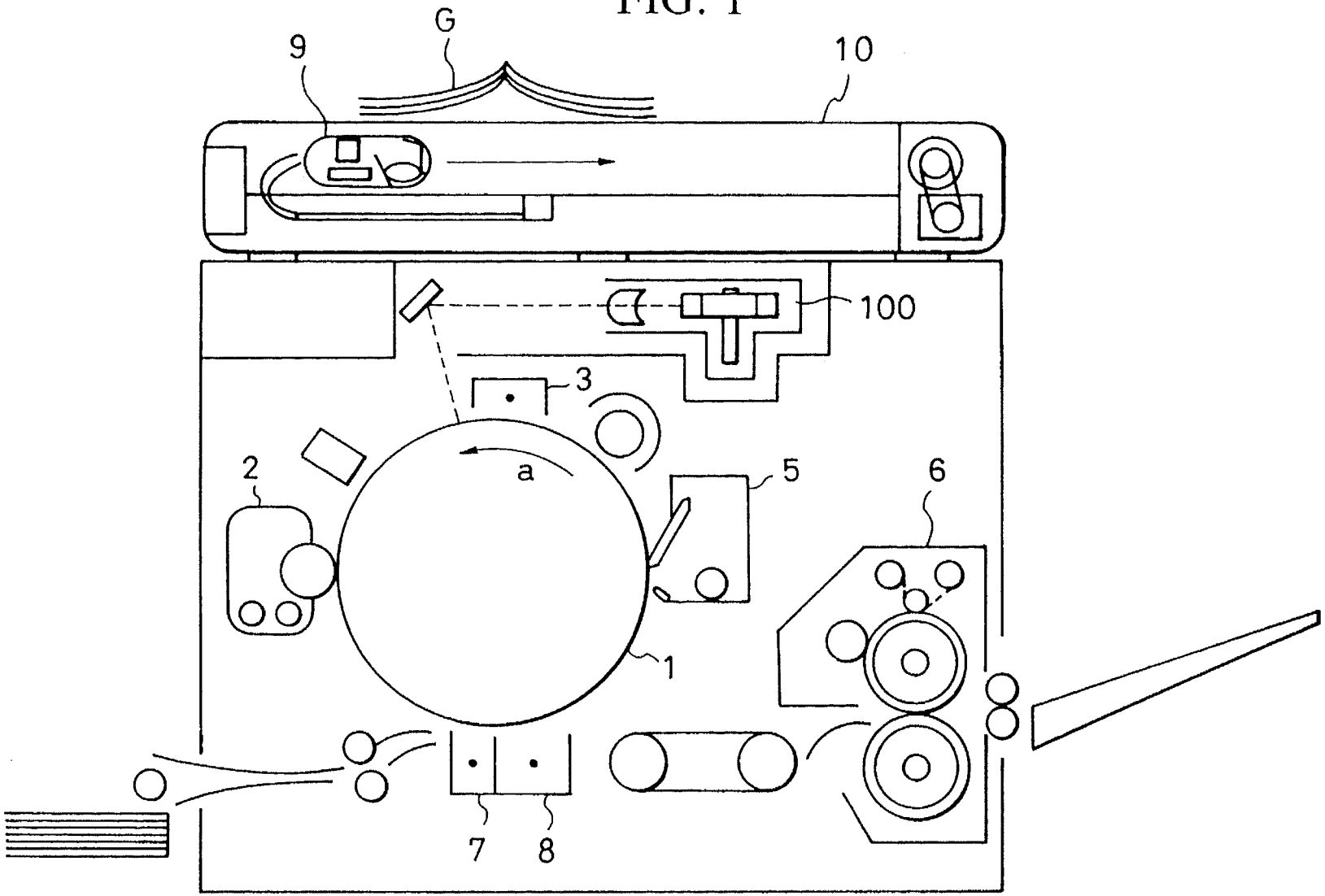
FIG. 1 is a schematic view showing the overall configuration of an embodiment of an image forming apparatus using a developing method according to the present invention.

FIG. 1 is a schematic view showing the overall configuration of an electrophotographic copying machine (an image forming apparatus) using a development method according to the present invention. Referring to FIG. 1, a document G is set with the side to be copied facing down on a document table 10. A copying operation is started by depressing a copy button. A unit 9 integrally composed of a document illumination lamp, a short focus lens array and a CCD sensor scans the document G during illumination, and a reflected light of the illumination scan light from the document G is condensed by the short focus lens array and directed onto the CCD sensor. The CCD sensor comprises a light receiving portion, a transfer portion and an output portion. Light signals are converted into electrical signals in the CCD light receiving portion, and are sequentially transferred from the transfer portion to the output portion in synchronization with clock pulses. Charge signals are converted to voltage signals in the output portion, multiplied, and output at low impedance. Analog signals thus obtained are converted to digital signals in a conventional image processing operation, and transmitted to a printer portion.

Figure 3:
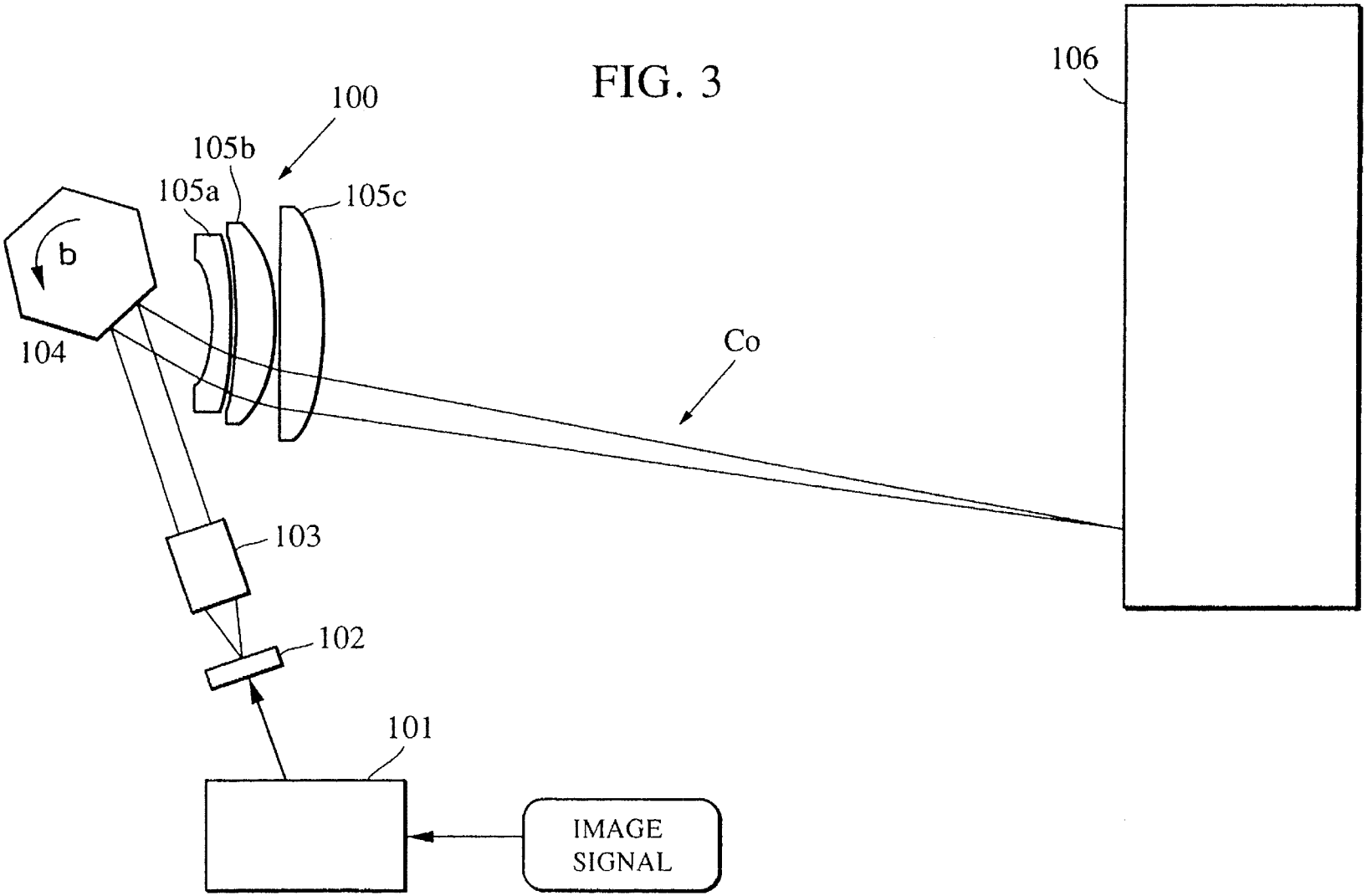
FIG. 3 is a schematic view of a laser scanning portion in the image forming apparatus shown in FIG. 1.

FIG. 3 is a schematic view showing the structure of a laser scanning portion 100 for scanning laser light in the above apparatus. In the laser scanning portion 100, laser light radiated from a solid laser device 102 by a light emission signal generator 101 based on input image signals is first converted into a substantially parallel light beam by a collimator lens system 103, scanned in the direction of the arrow Co by a rotary polygon mirror 104 rotating in the direction of the arrow b, and focused onto a scanned plane 106 of a photoconductive drum or the like in the shape of a spot by fθ lenses 105*a*, 105*b* and 105C. Such scanning of the laser light forms an exposure distribution for one scan stroke of an image on the scanned plane 106. By scrolling the scanned plane 106 by a predetermined amount in the direction perpendicular to the above scanning direction for every scan, exposure distributions in accordance with image signals can be obtained on the scanned plane 106.

Referring again to FIG. 1, electrostatic latent images are formed in the printer portion in response to the above image signals by using the laser scanning portion 100. A photoconductive drum 1 (an electrophotographic photoconductor) is rotated on a center shaft in a direction "a" at a predetermined peripheral velocity, and evenly charged (positively or negatively) by a charger 3 during the rotation. By scanning the light emitted from the solid laser device 102, whose emission is switched on and off in response to the image signals, onto the evenly charged photodoncutive drum 1 through the rotary polygon mirror 104 which is rotating at a high speed, electrostatic latent images corresponding to images on the document G are sequentially formed on a plane of the photoconductive drum 1.

Figure 2:
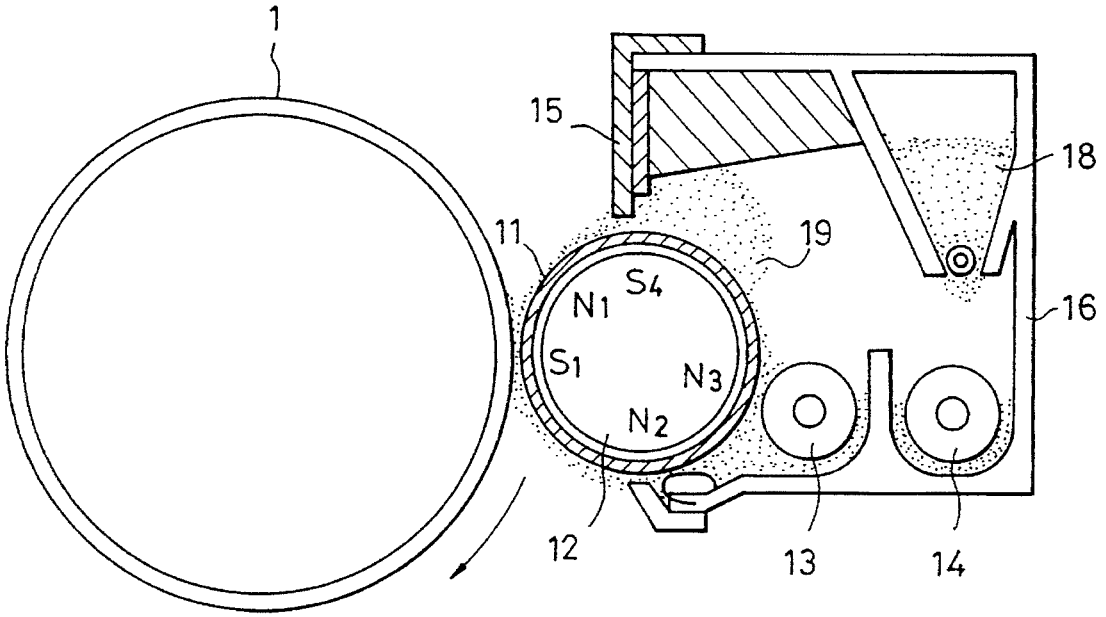
FIG. 2 is a schematic view showing the structure of a developer unit in the image forming apparatus shown in FIG. 1.

FIG. 2 is a schematic structural view of a developer unit 2 for developing the electrostatic latent images formed on the photoconductive drum 1, viewed from the rear side of FIG. 1. Referring to FIG. 2, the developer unit 2 is located opposed to the photoconductive drum 1, and is comprised of a developing sleeve 11, which constitutes a developer supporting means for transporting the developer to the developing position, a magnet roller 12 fixed in the developing sleeve 11 (which constitutes a magnetic field generating means), agitation screws 13 and 14 for agitating the developer, a regulating blade 15 located perpendicular to the developing sleeve 11 for forming a thin layer of the developer on the surface of the developing sleeve 11, and a developer container 16 for housing the developer and the above-mentioned agitation screws 13 and 14. The magnet roller 12 has magnetic poles S1, N2, N3, S4 and N1. The developer is a two-component developer consisting of toner 18 and magnetic carrier 19.

In this developer unit 2, the developer is attracted to and scooped up by pole N3 in cooperation with the rotation of the developing sleeve 11. The thickness of a layer of the developer is regulated by the regulating blade 15 during transportation of the developer from pole S4 to pole N1, and a thin layer of the developer is formed on the developing sleeve 11. When the layered developer is transported to the main developing pole S1, spikes of developer are formed by the magnetic force of the pole S1. The electrostatic latent images formed on the photoconductive drum 1 are developed with the developer provided in the shape of spikes. After that, the developer on the developing sleeve 11 is returned into the developer container 16 by a repulsive magnetic field of the poles N2 and N3.

DC and AC biases are applied to the developing sleeve 11 from an unillustrated power supply, with Vpp=200V and f=2000Hz as an AC component in this embodiment. Although application of the AC bias in the two-component development process generally increases the development efficiency and improves image quality, fogging is liable to occur. In this embodiment, this problem is solved by a method described below, and an improvement of image quality by the application of the AC bias is achieved.

The developer contains non-magnetic toner particles each having a diameter of 8 μm and magnetic carrier particles each having a diameter of 50 μm. The average charge amount of the toner is approximately 20 to 25 μC/g, and the magnetic carrier has a magnetization intensity of less than 200emu/cm$^3$, and preferably less than 120emu/cm$^3$, when a magnetic field of the main developing pole of 1000G is applied.

The toner image formed on the photoconductive drum 1 as described above is electrostatically transferred onto a transfer material by a transfer charger 7. Subsequently, the transfer material is electrostatically separated by a separation charger 8 and transported to a fuser 6. The toner image on the transfer material is fixed by heat therein and output.

On the other hand, after the toner image is transferred, the surface of the photoconductive drum 1 is cleared of any adhered contaminants, such as residual toner, by a cleaner 5, and the residual toner is reused for image formation over and over.

Furthermore, in this embodiment, stable output of images is achieved by using an amorphous silicon photoconductor, whose change in sensitivity is small and whose wear resistance is high, as a photoconductive drum.

However, a phenomenon called "fogging", in which toner adheres to a white portion, sometimes has occurred conventionally in use of such amorphous silicon photoconductor.

Fogging is a phenomenon in which toner having a relatively large charge amount in the developer adheres to the surface of the photoconductor by the action of a reflection force thereof. If the adhesive force based on the reflection force is larger than the toner retraction force based on the fog removal potential of the developing bias, then fogging occurs. The reflection force of the charged toner is greatly influenced by the dielectric constant of the photoconductor layer with which the toner is brought into contact, and increases as the dielectric constant increases. An ordinary organic photoconductor has a dielectric constant of approximately 3 to 3.5, while the amorphous silicon photoconductor has an extremely large dielectric constant, approximately 9 to 11, and therefore, fogging is liable to occur.

As a result of further study of the factor of fogging, the inventors of the present invention and others have found that the occurrence of fogging has a large dependence, in addition to the above factor, on the contact pressure of a magnetic brush formed of the two-component developer on the photoconductor in a magnetic field of a developing portion in a developer supporting means, that is, a developing sleeve.

Furthermore, it has been discovered that the contact pressure of the magnetic brush greatly depends upon the following factors:

1. the amount (M/S) of the developer shaped in a thin layer on the developing sleeve and the distance (S-D gap) between the developing sleeve and the photoconductor.

2. the state of the spikes in the magnetic brush, that is, the magnetization intensity (referred to as $\sigma d$ hereinafter) of the magnetic carrier per volume when the peak magnetic field intensity of the main developing pole is applied.

The magnetic characteristics of a magnetic carrier were measured by the automatic DC magnetization B-H characteristic recording apparatus BHH-50 from Riken Electronics Co., Ltd. FIG. 4 is a graph showing an example of the measurement result of magnetic characteristics obtained by the apparatus.

FIG. 5 is a graph showing the result of measuring the contact pressure of the magnetic brush when the gap (S-D gap) between the photoconductive drum and the developing sleeve is changed, where the magnetization intensity $\sigma d$ of the carrier is 200emu/cm$^3$ and the amount (M/S) of the developer is approximately 50 mg/cm$^2$. The photoconductor used was an amorphous silicon photoconductor.

Figure 6:
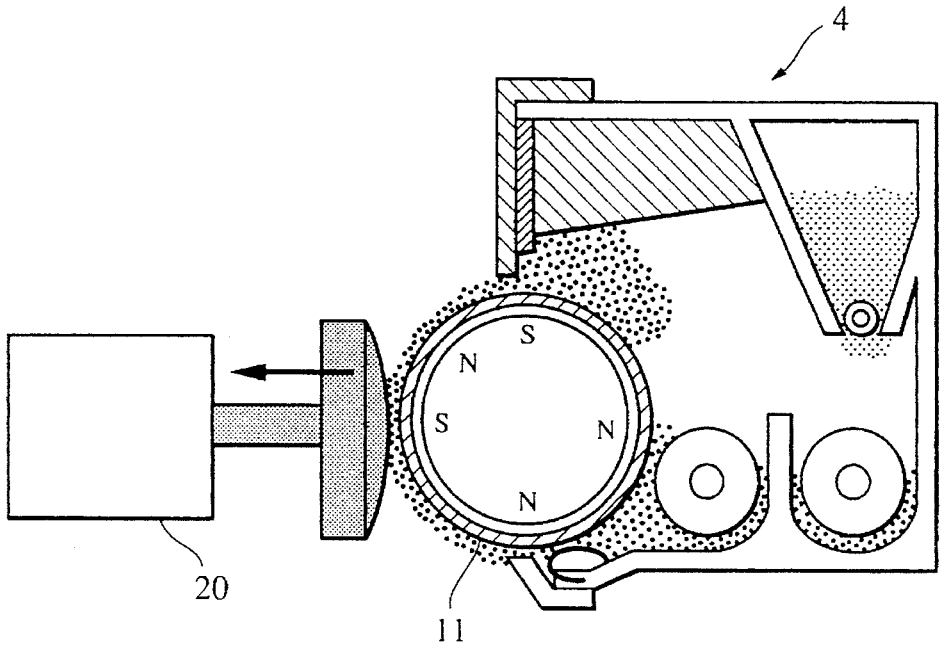
FIG. 6 is an explanatory view showing a process of measuring the contact pressure of a magnetic brush.

In the measurement of the contact pressure of the magnetic brush, as shown in FIG. 6, a pressure sensor 20 is located opposed to the developing sleeve 11 to selectively measure the pressure in the direction of the arrow. Furthermore, the contact area of the magnetic brush is measured, and the pressure is expressed in surface pressure per unit area (gf/cm$^2$).

The graph in FIG. 5 reveals that the contact pressure tends to rapidly increase as the S-D gap is shortened.

Figure 7:
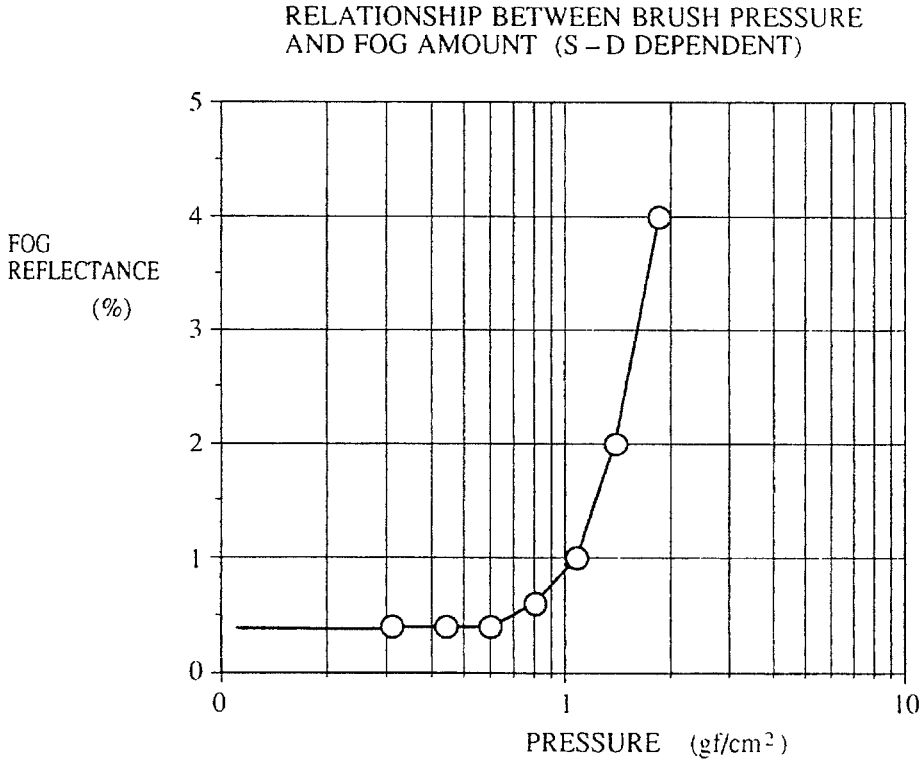
FIG. 7 is a graph showing the relationship between the contact pressure and the amount of fog when the S-D gap is changed.
Figure 6:
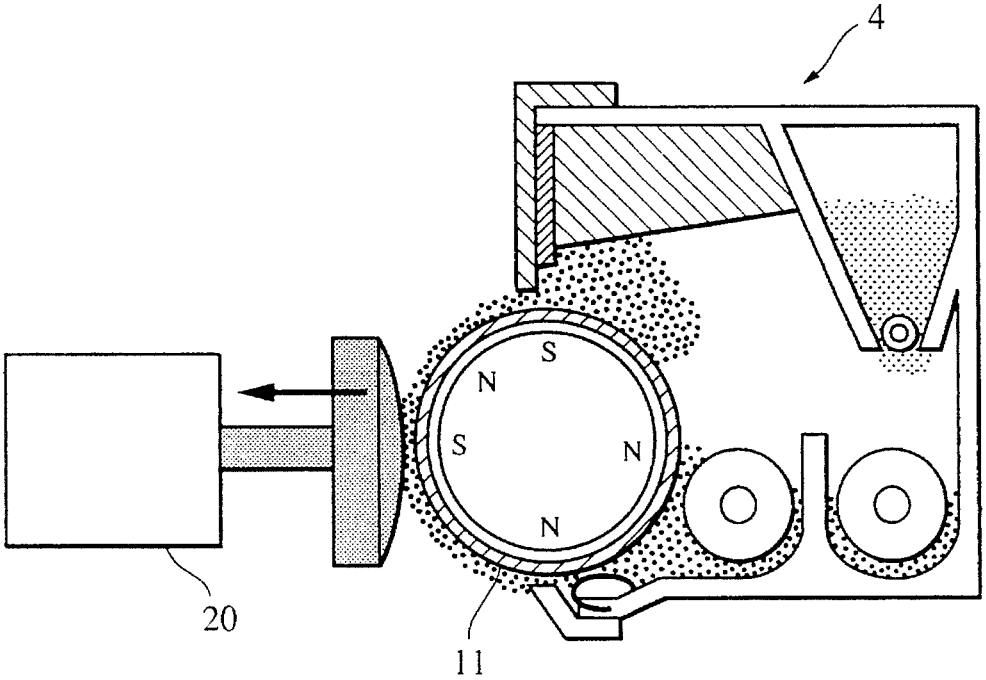
Figure 7:
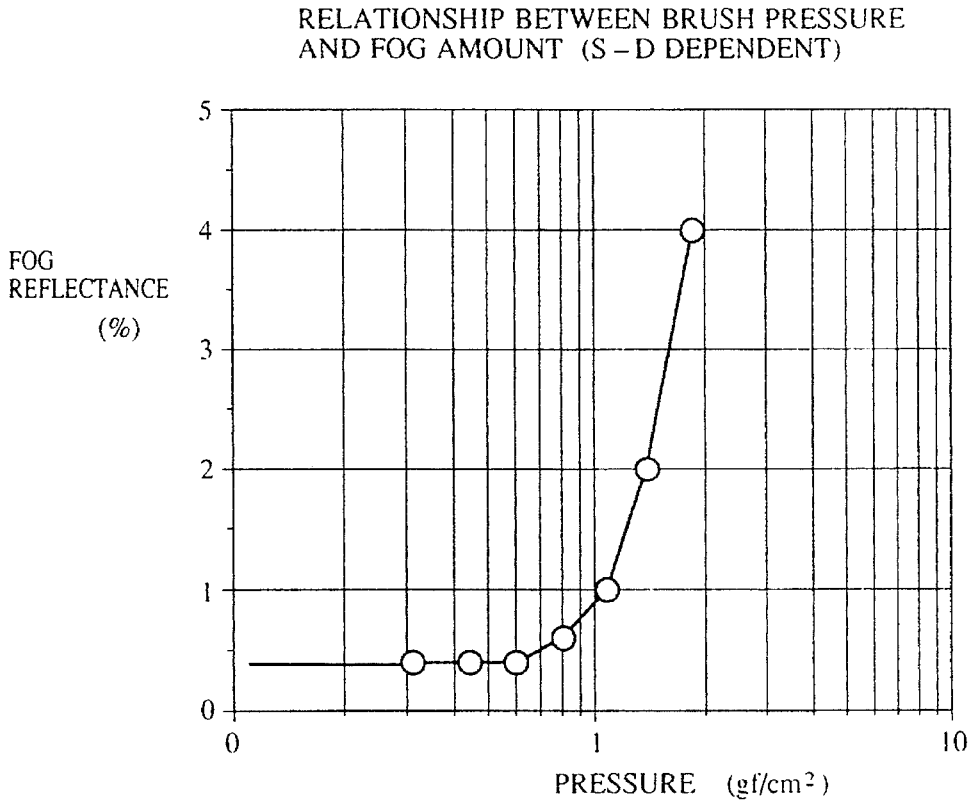

FIG. 7 is a graph explaining the relationship between the fog amount and the contact pressure to show how the fog amount changes as the S-D gap changes.

In order to remove the influence of the transfer paper, a measurement value of the fog amount is ordinarily found as a reflectance (%)=a reflectance (%) of a white portion of the transfer paper-a reflectance (%) of a fogged portion of the transfer paper.

As shown in the graph of FIG. 7, the fog amount decreased as the contact pressure decreased. When the contact pressure fell below 0.7gf/cm$^2$, the fog amount was fixed at an almost negligible value (less than approximately 0.5%).

According to the graph in FIG. 5, a preferable value of the S-D gap is more than approximately 800 μm to obtain a contact pressure less than 0.7gf/cm$^2$.

A fog reflectance(%) less than approximately 2% is allowable in subjective evaluation. Furthermore, it is said that fog is hardly recognized when the fog reflectance is less than 0.5%.

It appears that the fog amount is fixed when the contact pressure of the magnetic brush falls below 0.7gf/cm$^2$ because the toner adheres to a white portion not by the action of the mechanical rubbing or contact pressure of the magnetic brush, but by the action of an electrostatic reflection force based on charges of the toner below the value of the pressure.

In other words, it seems that the toner reciprocates within the S-D gap by the action of the alternating electric field of the developing bias, and a part of the toner adhered by the reflection force cannot be pulled back by the electric field of the developing bias. Consequently, the toner adheres even at the potential of the white portion, thereby causing fogging. This fogging phenomenon seems to occur even if the magnetic brush is not brought into contact with the photoconductor, that is, no pressure is applied, and the occurrence seems to mainly depend on the charge amount of the toner and the dielectric constant of the photoconductor. Small saturated fog reflectances in FIG. 7 indicate this slight fogging state.

However, when the contact pressure exceeds approximately 0.7gf/cm$^2$, the toner which reaches the photoconductor in the reciprocation motion thereof is rubbed by mechanical pressure of the magnetic brush, since the mechanical rubbing force and contact pressure of the magnetic brush are added. Therefore, since the adhesive force is increased, the fog amount seems to increase as the contact pressure increases.

As described above, in an image forming apparatus for developing an electrostatic latent image with a two-component developer composed of toner and magnetic carrier under an alternating electric field, the occurrence of fogging can be substantially reduced by making the contact pressure of a magnetic brush much lower than before, that is, less than 0.7gf/cm$^2$.

As the S-D gap is further widened, the contact pressure gets sufficiently close to 0gf/cm$^2$, and a non-contact state in which the magnetic brush is not in contact with the photoconductor is finally brought about. Since the contact pressure is 0gf/cm$^2$ in this non-contact state, as a matter of course, the occurrence of fogging is remarkably reduced. However, if the developer is brought into contact with the photoconductor in the developing system using the two-component developer according to the present invention, then the development efficiency is considerably reduced, and sufficient image density cannot be obtained.

Since the toner is supplied onto the surface of the photoconductor by bringing the developer into contact with the photoconductor in the two-component developing system, it is necessary to bring the developer into contact with the photoconductor and to rub the toner against the photoconductor with the magnetic brush with a small pressure. The pressure may be small as the electric field of the developing bias also acts on the toner.

Since not only an ordinary DC bias but also an AC bias is applied as a developing bias to enhance the development efficiency in the developing system of the present invention, the pressure needed to transfer the toner may be even smaller.

According to tests carried out by the inventors of the present invention, it has been confirmed that practical development efficiency and sufficient image density can be obtained with the assistance of an AC bias when the brush pressure is more than 0.1gf/cm$^2$ in this embodiment, and that there is an optimal range of brush pressure with respect to the restriction of fogging and the image density.

As described above, in an image forming apparatus for developing an electrostatic latent image with two-component developer composed of a toner and a magnetic carrier under an alternating electric field, an image which has no fog and is excellent in development efficiency can be obtained by setting the contact pressure of the magnetic brush within a range of 0.1 to 0.7gf/cm$^2$.

Another embodiment of an image forming apparatus according to the present invention will now be described.

Although the pressure contact of the magnetic brush is reduced by changing the S-D gap in the above embodiment, in the present embodiment the pressure contact is reduced by changing the magnetic characteristics of the magnetic carrier.

More specifically, the pressure contact of the magnetic brush is greatly dependent upon the spiking state thereof, that is, the magnetization intensity of the magnetic carrier per volume (this value is referred to as $\sigma d$ hereinafter) when the peak magnetic field intensity of the main developing magnetic pole is applied.

Figure 8:
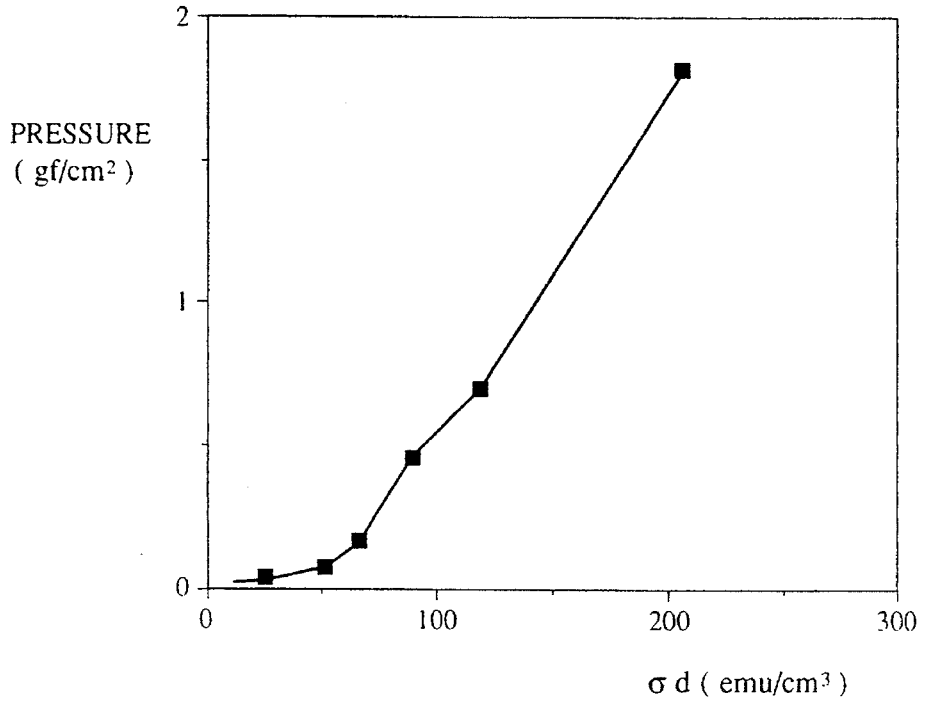
FIG. 8 is a graph showing the relationship between the magnetization intensity $\sigma d$ and the contact pressure.

FIG. 8 is a graph showing a relationship between the magnetization intensity $\sigma d$ per volume and the contact pressure of the magnetic brush when the magnetization intensity $\sigma d$ is changed from 20 to 200emu/cm$^3$. At this time, the amount of developer on the developing sleeve is approximately 50mg/cm$^2$, the S-D gap is 500 μm, and the peak magnetic field intensity of the main developing magnetic pole is 1000G.

As shown in the graph of FIG. 8, the pressure contact of the magnetic brush can be changed by changing the magnetization intensity $\sigma d$ of the magnetic carrier per volume. It appears that, when particles of the carrier form spikes in the developing magnetic field, although each of the spikes behaves like a bar magnet, since the force acting between the carrier particles decreases as the magnetization intensity of the carrier decreases, the spikes are liable to crumble. As a result, the brush pressure is lowered.

The contact pressure can be lowered below 0.7gf/cm$^2$ by setting $\sigma d$ below 120emu/cm$^3$.

Figure 9:
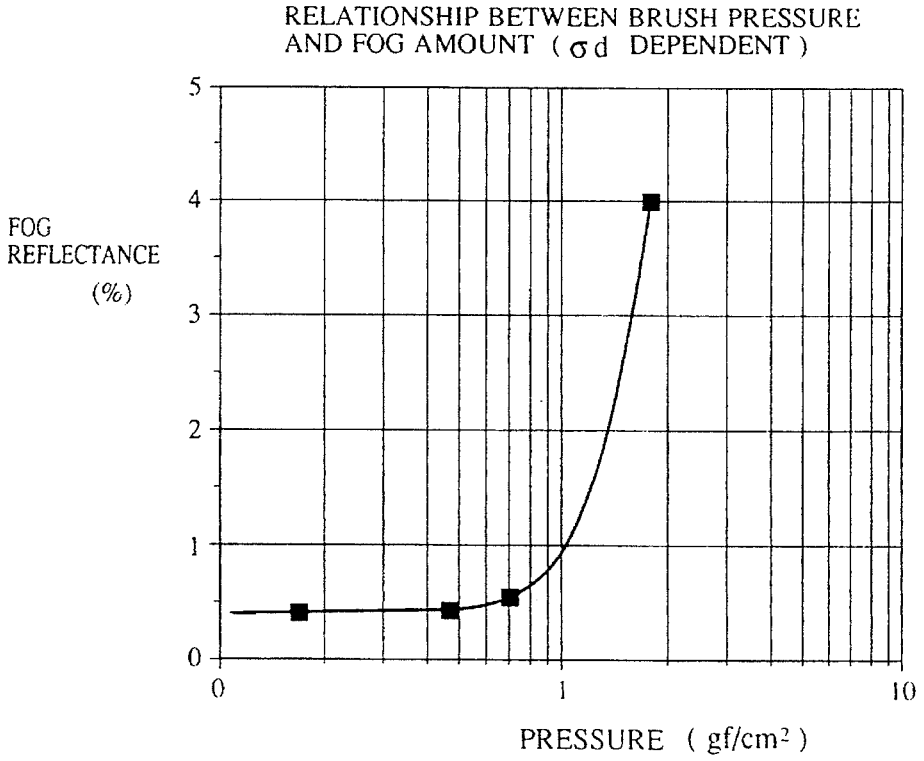
FIG. 9 is a graph showing the relationship between the contact pressure and the amount of fog when the magnetization intensity σd is changed.
Figure 10:
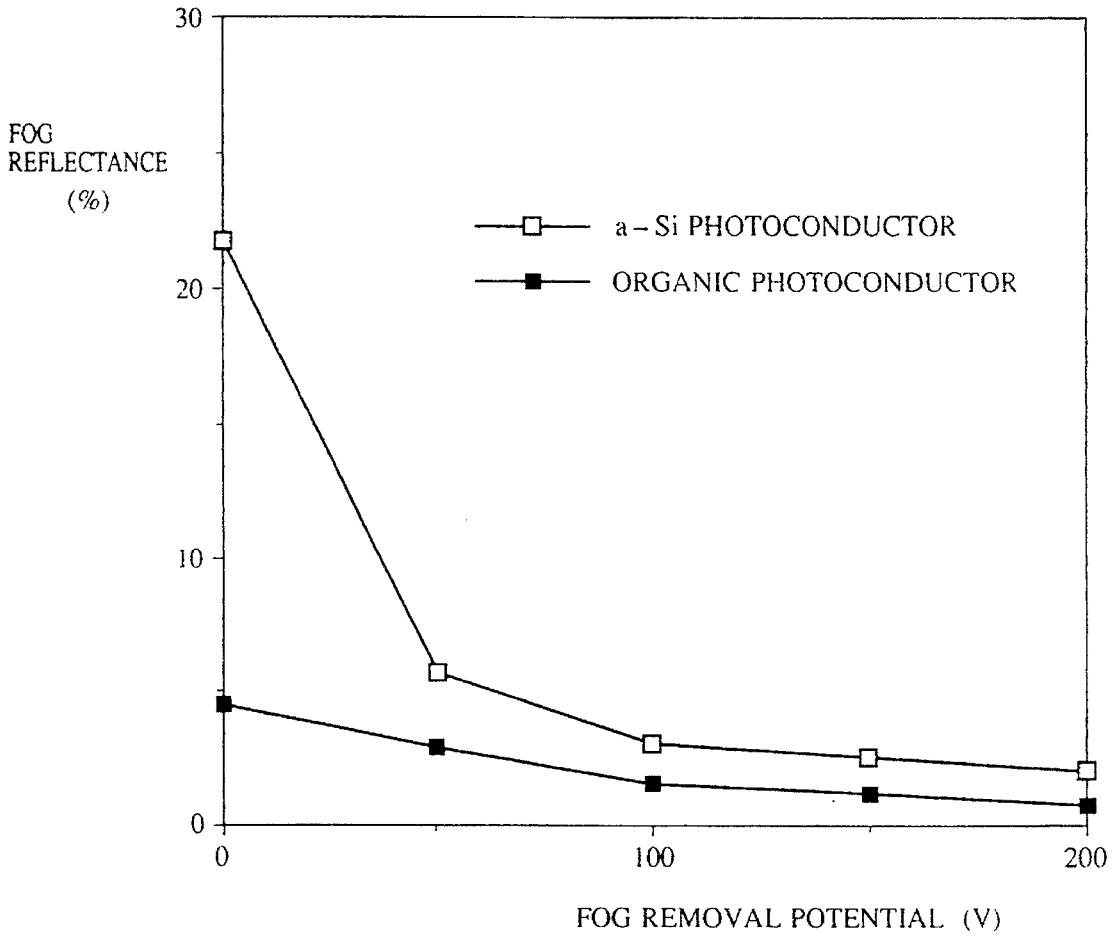
FIG. 10 is a graph showing the relationship between various photoconductors and the amount of fog.

FIG. 9 is a graph showing the relationship between the contact pressure and the fog reflectance at that time. The graph revealed, in the same manner as in FIG. 7, that the fog amount was decreased by reducing the contact pressure and the fog reflectance was fixed at an almost negligible value (below approximately 0.5%) when the contact pressure fell below approximately 0.7gf/cm$^2$.

The method of reducing the contact pressure by decreasing the magnetization intensity $\sigma d$ of the carrier is advantageous in that, since it is unnecessary to widen the S-D gap, as distinguished from the above embodiment, a high development efficiency is maintained by the action of the alternating electric field of the developing bias and therefore, an ideal developing method capable both of reducing fogging and enhancing image quality can be achieved.

Furthermore, reducing the magnetization intensity $\sigma d$ of the carrier has another advantage in that noises in a halftone portion arising from spikes of the magnetic brush are reduced since the density of the spikes is increased.

When the magnetization intensity $\sigma d$ of the carrier is too small, adhesion of the carrier occurs. In other words, when $\sigma d$ is small, since the magnetic restraint exerted on particles of the carrier is decreased, the carrier particles adhere onto the surface of the photoconductor. The intensity of the developing magnetic pole is ordinarily 700 to 1500G. It has been confirmed by experiment that a magnetization intensity $\sigma d$ of more than 30emu/cm$^3$ is required to reduce the adhesion of the carrier in the developing magnetic field.

Consequently, in this embodiment, it has been confirmed that a good image without any fog and carrier adhesion can be obtained by setting the magnetization intensity $\sigma d$ of the carrier within a range of 30 to 120emu/cm$^3$.

The present invention is not limited to the above embodiments, and is applicable to an image forming apparatus for developing an electrostatic latent image formed on a photoconductor by using a two-component developer composed of a magnetic carrier and a toner containing colorant.

For example, in a color image forming apparatus having a plurality of developer units (for yellow, magenta, cyan, black, or the like), since halftone images are mainly formed, high image quality is required and fog components in a development process with these colors are accumulated on an image to be formed, and it is a severe problem how to reduce the fog components arising in the development. Therefore, the application of the present invention to such kind of image forming apparatus has a positive effect.

Furthermore, as a photoconductor used in the present invention, for example, organic and selenium photoconductors are available as an alternative to the amorphous silicon photoconductor. Needless to say, fogging can be further reduced by carrying out the present invention with such photoconductors since either of these photoconductors has a low dielectric constant.

While the embodiments of the present invention are described above, the present invention is not limited to the embodiments, and modifications may be made without departing from the technical idea of the present invention.

What is claimed is:

1. A developing method comprising the steps of:

bearing a developer including toner particles and carrier particles on a developer bearing member to a developing region formed between the developer bearing member and an image bearing member bearing an electrostatic image thereon;

forming a magnetic brush of carrier particles and toner particles on the developer bearing member in the developing region; and rubbing the image bearing member in the developing region with the magnetic brush formed on the developer bearing member with a contact pressure equal to $0.7gf/cm^2$ or less.

2. A developing method according to claim 1, wherein the contact pressure is in the range of $0.1gf/cm^2$ to $0.7gf/cm^2$.

3. A developing method according to claim 1, wherein the magnetic brush forming step comprises the steps of:

providing the developer bearing member with a magnetic pole at a developing portion thereof; and providing the carrier particles with a magnetization intensity equal to $120emu/cm^3$ or less when the peak magnetic field intensity of the magnetic pole in a portion of the developer bearing member closest to the image bearing member is applied.

4. A developing method according to claim 3, wherein the magnetization intensity is in the range of $30emu/cm^3$ to $20emu/cm^3$.

5. A developing method according to claim 1, wherein the image bearing member includes an amorphous silicon photoconductor.

6. A developing method according to claim 1, further comprising the step of forming an alternating electric field between the image bearing member and the developer bearing member.

* * * * *

UNITED STATES PATENT AND TRADEMARK OFFICE

CERTIFICATE OF CORRECTION

PATENT NO. : 5,459,559

DATED : October 17, 1995

INVENTOR(S) : YUKIO NAGASE, ET AL.

It is certified that error appears in the above-indentified patent and that said Letters Patent is hereby corrected as shown below:

Column 4

Line 16, "photodoncutive" should read --photoconductive--.

Column 10

Line 8, "20emu/$cm^3$." should read --120emu/$cm^3$.--.

Signed and Sealed this

Sixth Day of February, 1996

*Attest:*

Bruce Lehman

BRUCE LEHMAN

*Attesting Officer*

*Commissioner of Patents and Trademarks*